US007926619B2

(12) United States Patent
Stein et al.

(10) Patent No.: US 7,926,619 B2
(45) Date of Patent: Apr. 19, 2011

(54) INDUSTRIAL TRUCK WITH CABLE STORAGE DEVICE

(75) Inventors: Gerald Stein, Hosbach (DE); Alfred Spatz, Haibach (DE)

(73) Assignee: Linde Material Handling GmbH (DE)

( * ) Notice: Subject to any disclaimer, the term of this patent is extended or adjusted under 35 U.S.C. 154(b) by 0 days.

(21) Appl. No.: 12/046,495

(22) Filed: Mar. 12, 2008

(65) Prior Publication Data

US 2008/0245616 A1 Oct. 9, 2008

(30) Foreign Application Priority Data

Apr. 4, 2007 (DE) ..... 10 2007 016 269

(51) Int. Cl.
*B66F 9/08* (2006.01)

(52) U.S. Cl. ..... 187/226; 187/228; 191/12 R; 414/918

(58) Field of Classification Search ..... 187/226, 187/228; 191/12 R; 414/918
See application file for complete search history.

(56) References Cited

U.S. PATENT DOCUMENTS

| | | | | | |
|---|---|---|---|---|---|
| 3,289,869 | A | * | 12/1966 | Hoyt | 414/631 |
| 3,339,768 | A | * | 9/1967 | Dixon | 187/228 |
| 3,612,318 | A | * | 10/1971 | Ramsey | 187/228 |
| 3,941,259 | A | * | 3/1976 | Hoffmeister et al. | 376/262 |
| 3,997,029 | A | * | 12/1976 | Evans | 187/227 |
| 4,244,449 | A | * | 1/1981 | Renk et al. | 187/228 |
| 4,691,806 | A | * | 9/1987 | Jansen et al. | 187/227 |

FOREIGN PATENT DOCUMENTS

DE 196 39 746 C2 3/1997

* cited by examiner

*Primary Examiner* — Thomas J Brahan
(74) *Attorney, Agent, or Firm* — The Webb Law Firm

(57) ABSTRACT

An industrial truck has a lifting mast (1) with a fixed mast (1*a*) and at least one movable mast (1*b*) that can move vertically in relation to the fixed mast. A load lifting device (2) can be moved up and down on the movable mast (1*b*). Located on the movable mast (1*b*) and/or on the load lifting device (2) is at least one electrical component which is connected with at least one electrical cable (3). The cable (3) is guided through a cable storage device (4) which is constructed according to the pulley block principle.

10 Claims, 4 Drawing Sheets

INDUSTRIAL TRUCK WITH CABLE STORAGE DEVICE

CROSS REFERENCE TO RELATED APPLICATIONS

This application claims priority to German Application No. 10 2007 016 269.5 filed Apr. 4, 2007, which is herein incorporated by reference in its entirety.

BACKGROUND OF THE INVENTION

1. Field of the Invention

This invention relates to an industrial truck having a lifting mast with a fixed mast and at least one movable mast that can be extended vertically in relation to the fixed mast. A load lifting device can be moved up and down on the movable mast. On the movable mast and/or on the load lifting device, there is at least one electrical component connected with at least one electrical cable.

2. Description of Related Art

Industrial trucks are known in many different configurations. Electrical components that must be supplied with electrical energy or electrical signals are frequently located on the movable mast and/or the load lifting device. On lifting masts with a large lifting height, such as duplex and triplex masts, electrical cables provided with slip rings can be payed out for this purpose to supply power and signals to the electrical components even in the raised position. Contact resistance thereby occurs disadvantageously at the slip rings. Furthermore, slip rings can be inserted only with certain types of cables, and not at all on cables that require a continuous shielding of the cable conductors (e.g., for cameras having a cable for video signals). Moreover, for space reasons, slip rings can connect only a relatively limited number of cable conductors.

SUMMARY OF THE INVENTION

Therefore, it is an object of the invention to provide an industrial truck of the general type described above but on which the electrical connection to the electrical components located on the movable mast or the load lifting device is improved.

In one non-limiting embodiment, the invention teaches that the cable is routed through a cable storage device which is configured according to the pulley block principle.

Cable storage devices of this type are in themselves known from other applications. For example, DE 196 39 746 C2 (herein incorporated by reference) describes a cable storage device for electric lawn mowers which consists of a support with a cable storage device that is suspended on the support and contains two sets of storage rollers.

On an industrial truck of the invention, there is a largely lossless transmission of energy and signals to the electrical components that can be moved up and down on the lifting mast because, theoretically, there is no contact resistance on slip rings. Continuously shielded cables can also be used.

In one advantageous embodiment of the invention, the cable storage device is located on the side of the lifting mast. Nevertheless it is also possible for the cable storage device to be located parallel to a tilting cylinder located on top of the lifting mast. Both locations eliminate interference with visibility.

The cable storage device advantageously has a weighted and/or spring-loaded set of storage rollers which can be moved toward the maximum storage capacity. A tension is thereby always exerted on the cable connected with the electrical component so that when the elevated components are lowered, the electrical cable is retracted into the cable storage device. The number of freewheeling rollers of the storage roller set that are located next to one another and facing one another determines the length of cable that can be stored.

If the cable storage device has a closed housing, the system is protected against external factors.

BRIEF DESCRIPTION OF THE DRAWING(S)

Additional advantages and details of the invention are explained in greater detail below with reference to the exemplary embodiment illustrated in the accompanying schematic figures, in which like reference symbols identify like parts throughout:

DESCRIPTION OF THE PREFERRED EMBODIMENT(S)

Figure 1:
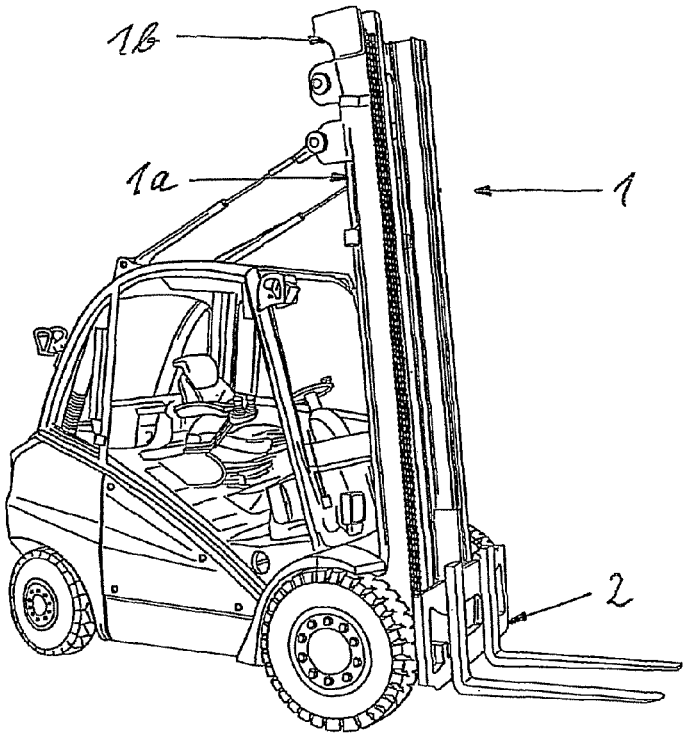
FIG. 1 is a perspective view of an industrial truck incorporating features of the invention.

FIG. 1 shows an industrial truck in the form of a counterweighted fork-lift truck. On the front of the fork-lift truck is a telescoping lifting mast 1 (e.g. duplex or triplex lifting frame) having a fixed mast 1*a* and at least one extendable and retractable movable mast 1*b*. On the movable mast 1*b*, there is a load lifting device 2, preferably realized in the form of a load fork which can be moved up and down.

On the load lifting device 2 and/or on the movable mast 1*b* of the lifting mast 1, there can be one or more electrical components 100 (see FIG. 3), supplied with electrical energy or electrical signals by a cable 3.

Figure 2:
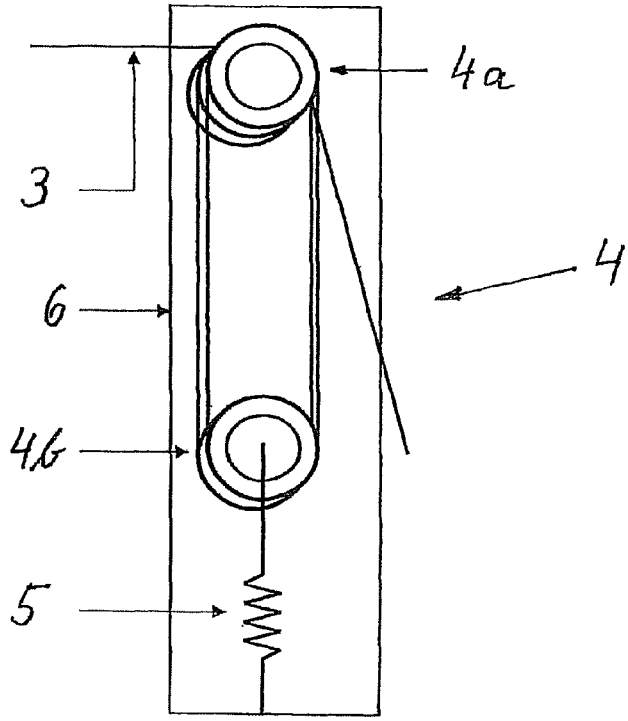
FIG. 2 is a schematic diagram of a cable storage device of the invention.

The invention teaches that the cable 3 is guided via a cable storage device 4 that is realized according to the pulley block principle of the type that is illustrated schematically in FIG. 2. The cable storage device 4 has a pulley block system comprising two sets 4*a* and 4*b* of storage rollers and in the exemplary embodiment illustrated in FIGS. 2 to 4 is oriented vertically and is fastened to the fixed mast 1*a* next to the lifting mast 1 (see also FIGS. 3, 4 and 5).

The bottom set 4*b* of storage rollers illustrated in FIGS. 2 to 5 is vertically movable with respect to the upper set 4*a* of storage rollers and is pressed downwardly by its own weight and by the force of a spring 5, i.e. in the direction of the maximum storage capacity of the cable storage device 4. Both sets 4*a* and 4*b* of storage rollers as well as the spring 5 and the stored segment of the cable 3 are protected inside a housing 6.

Figure 3:
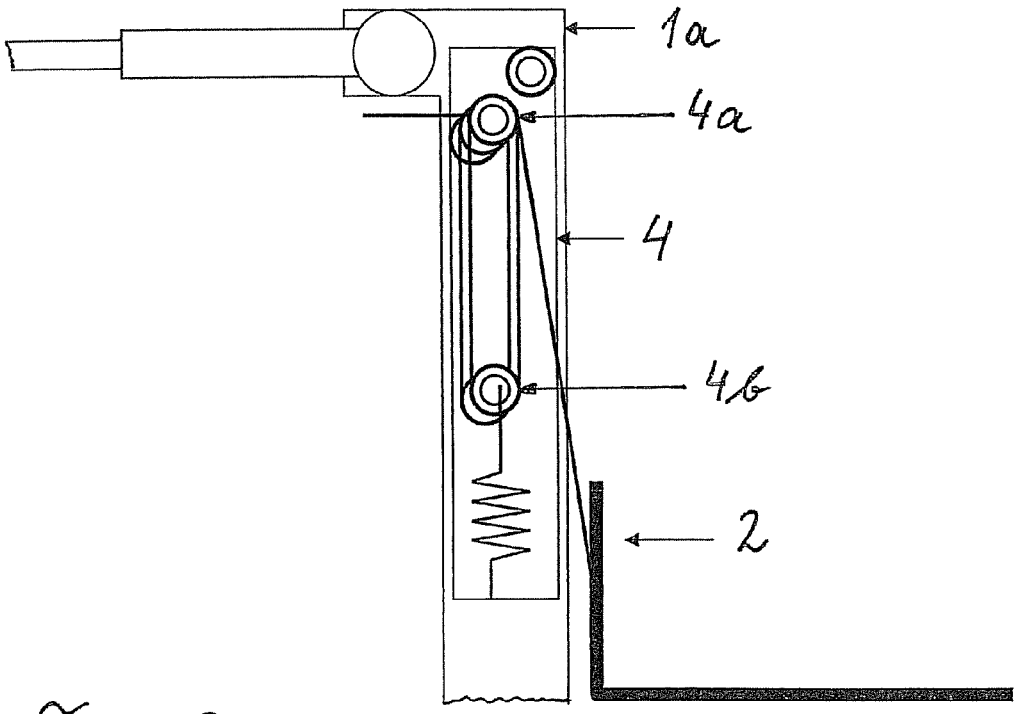
FIG. 3 is a side view of a lifting mast with a cable storage device, with the load lifting device in a lowered position.

FIG. 3 shows an industrial truck of the invention with the lifting mast 1 retracted and the load lifting device 2 in the lowered position. In this case, approximately two-thirds of the cable 3 is located in the cable storage device 4.

Figure 4:
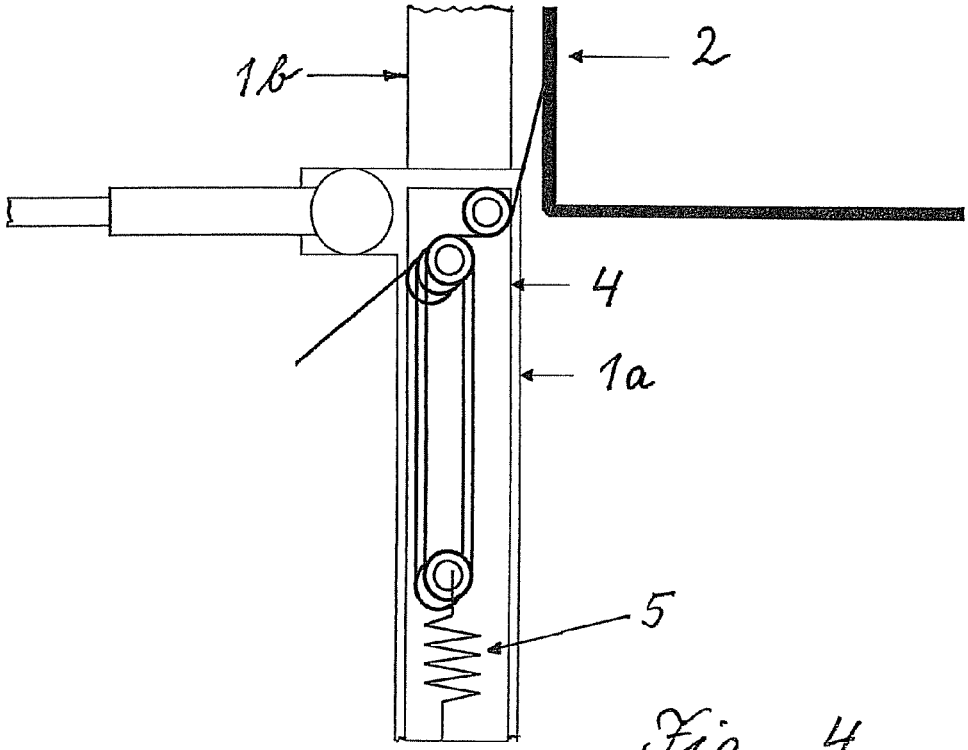
FIG. 4 is a side view of the lifting mast with a cable storage device of FIG. 3 with the load lifting device in a raised position.
Figure 5:
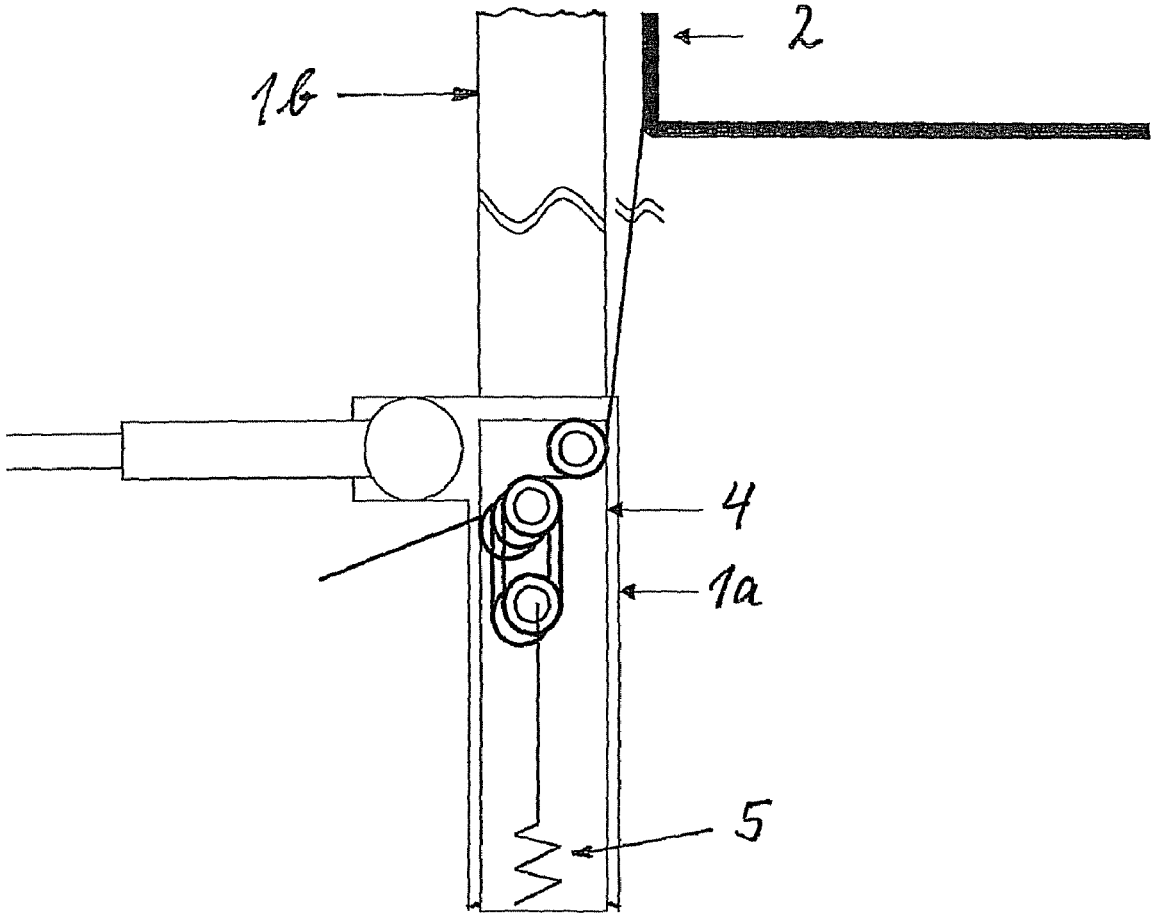
FIG. 5 is a side view of the lifting mast with a cable storage device of FIG. 3 with the load lifting device raised and the lifting mast extended.

In the embodiment shown in FIG. 4, the load lifting device 2 is located on the upper end of the fixed mast 1*a*. As the movable mast 1*b* begins to be extended from the fixed mast, the cable 3 is located almost entirely in the cable storage device 4 where the maximum possible distance is present between the sets 4*a* and 4*b* of storage rollers.

When the lifting mast 1 is fully extended (see FIG. 5), the load lifting device 2 is all the way up and the cable storage device 3 is almost empty, i.e. the distance between the two sets 4*a* and 4*b* of storage rollers is minimal and the spring 5 is extended to its maximum extent.

Figure 6:
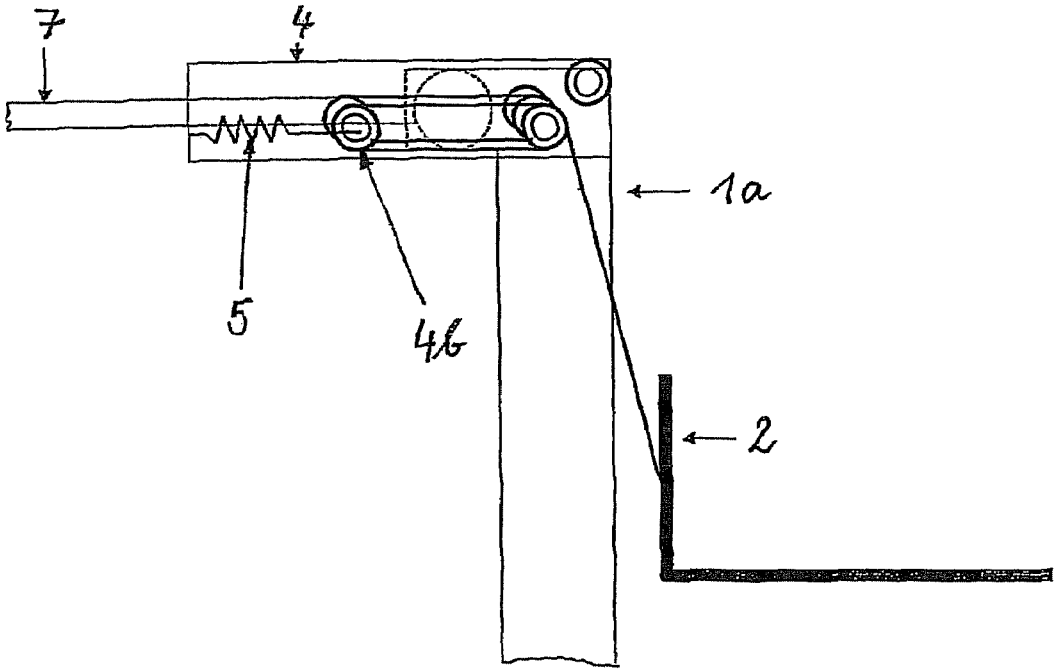
FIG. 6 is a side view of a lifting mast with a cable storage device of the invention located in the vicinity of a tilting cylinder, with the load lifting device in the lowered position.
Figure 7:
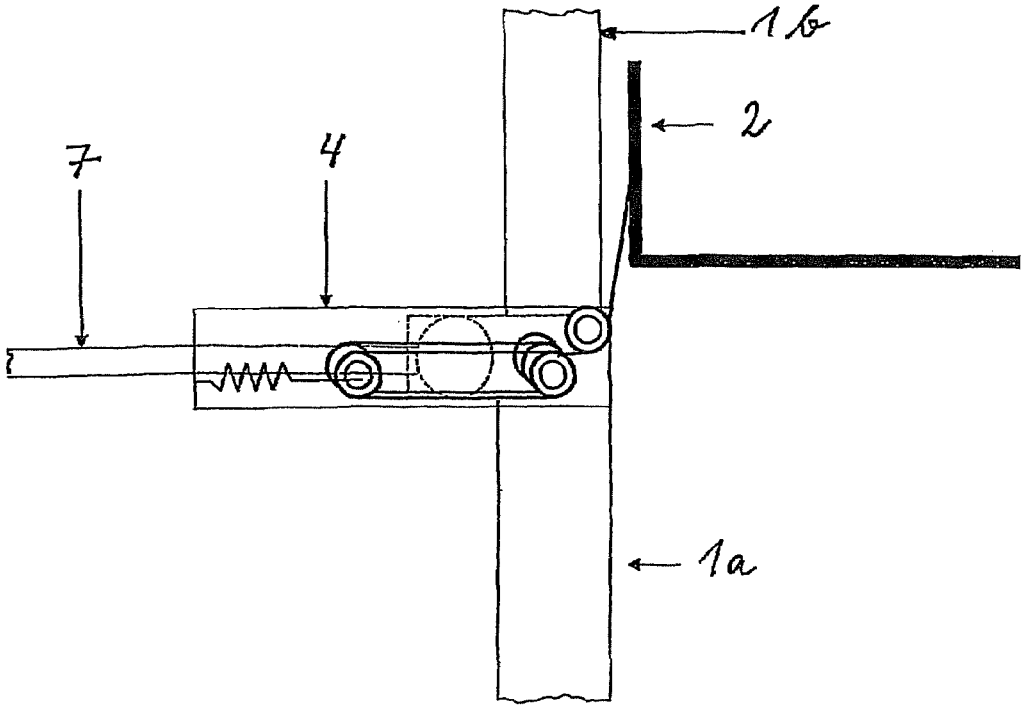
FIG. 7 is a side view of the lifting mast with a cable storage device of FIG. 6 located in the vicinity of the tilting cylinder with the load lifting device in the raised position.

In the embodiment illustrated in FIGS. 6 and 7, the cable storage device 4 is oriented parallel to an upper tilting cylinder 7 of the lifting mast 1. The function is analogous to the function of the cable storage device 4 located on the side of the lifting mast 1 illustrated in FIGS. 3 to 5. However, the only force acting in the direction of the maximum storage capacity is the force of the spring 5 and not the dead weight of the set 4*b* of storage rollers.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. An industrial truck comprising:

a lifting mast having a fixed mast and at least one movable mast vertically movable in relation to the fixed mast;

a load lifting device movable up and down on the movable mast;

at least one electrical component located on the movable mast or on the load lifting device, wherein the at least one electrical component is connected with at least one electrical cable; and a cable storage device having a pulley block system oriented on a longitudinal axis of the cable storage device, the pulley block system being positioned within the cable storage device and comprising a first roller having a first central pivot-point and a second roller having a second central pivot-point, wherein the first roller is movable on the longitudinal centerline of the cable storage device with respect to the second roller, and wherein the cable is guided through the cable storage device and tension is maintained on the cable at least partially by the force of a spring positioned within the cable storage device and oriented along the longitudinal centerline of the cable storage device.

2. The industrial truck of claim 1, wherein the cable storage device is located laterally with respect to the lifting mast.

3. The industrial truck of claim 2, wherein the cable storage device has a closed housing.

4. The industrial truck of claim 1, wherein the cable storage device is oriented parallel to a lifting cylinder on top of the lifting mast.

5. The industrial truck of claim 4, wherein the cable storage device has a closed housing.

6. The industrial truck of claim 1, wherein the cable storage device has a closed housing.

7. The industrial truck of claim 1, wherein the pulley block system further comprises a sheave positioned outside the cable storage device.

8. The industrial truck of claim 7, wherein the cable is guided into the cable storage device beneath the sheave.

9. The industrial truck of claim 1, wherein a portion of the cable engages the first roller and the second roller without crossing the longitudinal centerline.

10. The industrial truck of claim 1, wherein the cable storage device further comprises a longitudinal opening corresponding to the distance between the first roller and the second roller.

* * * * *

UNITED STATES PATENT AND TRADEMARK OFFICE

CERTIFICATE OF CORRECTION

PATENT NO. : 7,926,619 B2
APPLICATION NO. : 12/046495
DATED : April 19, 2011
INVENTOR(S) : Gerald Stein et al.

It is certified that error appears in the above-identified patent and that said Letters Patent is hereby corrected as shown below:

Claim 1, col. 4, line 2, "longitudinal axis" should read -- longitudinal centerline --

Signed and Sealed this
Twentieth Day of September, 2011

David J. Kappos

David J. Kappos
*Director of the United States Patent and Trademark Office*